US006142889A

United States Patent [19]

Schaubach

[11] Patent Number: 6,142,889

[45] **Date of Patent: *Nov. 7, 2000**

[54] BATTING PRACTICE APPARATUS

[76] Inventor: James P. Schaubach, 5643 Bluffs Dr., Rocklin, Calif. 95677

[ * ] Notice: This patent is subject to a terminal disclaimer.

[21] Appl. No.: 08/400,129

[22] Filed: Mar. 6, 1995

Related U.S. Application Data

[63] Continuation of application No. 08/014,712, Feb. 8, 1998, abandoned.

[51] Int. Cl.[7] ..... A63B 69/00

[52] U.S. Cl. ..... 473/426; 473/415; 473/424

[58] Field of Search ..... 273/26 E, 26 EA, 273/29 A, 58 C, 200, 411

[56] References Cited

U.S. PATENT DOCUMENTS

| | | | |
|---|---|---|---|
| 1,014,233 | 1/1912 | Kip | 273/200 |
| 2,547,776 | 4/1951 | Rankin . | |
| 2,942,883 | 6/1960 | Moore . | |
| 3,086,775 | 4/1963 | Albert | 273/26 E |
| 3,214,166 | 10/1965 | Gaudet | 273/26 E |
| 3,262,703 | 7/1966 | Hodlick | 273/58 C |
| 3,477,717 | 11/1969 | Clark | 273/58 C |
| 3,531,115 | 9/1970 | Alexander | 273/58 C |
| 3,637,209 | 1/1972 | Raut . | |
| 3,729,195 | 4/1973 | Hutt | 273/29 A |
| 3,907,287 | 9/1975 | Fox et al. | 273/26 E |
| 3,994,494 | 11/1976 | Kelley | 273/26 E |
| 4,147,353 | 4/1979 | Moore | 273/58 C |
| 4,186,921 | 2/1980 | Fox . | |
| 4,350,338 | 9/1982 | May | 273/58 C |
| 4,415,155 | 11/1983 | Goudreau . | |
| 4,577,864 | 3/1986 | Aldrich . | |
| 4,609,197 | 9/1986 | Vodin | 273/184 B |
| 4,846,472 | 7/1989 | Terza | 273/26 E |
| 4,867,448 | 9/1989 | Judd | 273/58 C |
| 5,165,682 | 11/1992 | McGukin | 273/26 E |

FOREIGN PATENT DOCUMENTS

| | | | |
|---|---|---|---|
| 61023 | 3/1971 | Australia | 233/58 C |
| 1354524 | 5/1974 | Australia | 233/58 C |
| 204451 | 7/1959 | Austria . | |
| 2016717 | 11/1977 | Germany . | |

*Primary Examiner*—Jeanette Chapman
*Assistant Examiner*—Mitra Aryanpour
*Attorney, Agent, or Firm*—Joseph E. Gerber

[57] ABSTRACT

A tethered ball-type batting practice apparatus comprised of a nonresilient first tether portion, a swivel, a linearly resilient second tether portion, a ball and a moderately flexible sleeve is disclosed. The hollow, lightweight ball cooperates with the resilient second tether portion to reduce the likelihood of the ball being torn from the tether, while giving a batter the authentic feel of having hit a standard ball. The moderately flexible sleeve prevents the tether from wrapping around the batter's bat. And, the resilient second tether portion permits the swivel to work more efficiently in preventing the tether's twisting.

6 Claims, 3 Drawing Sheets

BATTING PRACTICE APPARATUS

This is a continuation of application Ser. No. 08/014,712, filed Feb. 8, 1993 abandoned.

BACKGROUND OF THE INVENTION

1. Field Of The Invention

The present invention relates generally to training equipment for baseball and related games, and more specifically to apparatus for perfecting the skill of batting the ball used in such games.

2. Description Of The Related Art

In the game of baseball, and related games such as softball and cricket, it is important for every player to be proficient at batting. Batting can be practiced throughout a player's life; it is a skill which is able to be continuously improved with diligent effort.

Unfortunately, conventional batting practice usually requires the time and attention of several people, in addition to the practicing batter, to be carried out successfully. A pitcher is essential, and it is helpful to have the cooperation of a catcher and several fielders. Thus, children, and beginning batters of every age, rarely get as much practice as they might need to achieve their full level of potential batting proficiency.

In order to help fulfill players' needs for more batting practice, and to circumvent the problems caused by the constant scarcity of cooperative fielders, various devices which permit the batting act to be simulated have been developed and employed. One familiar to children, and those teaching them to bat, is called a "tee." It comprises an upstanding, flexible post atop which a ball may be placed at a comfortable swing-level. A tee is helpful in teaching the most basic rudiments of a proper swing because presenting a stationary ball to a beginning batter eliminates the need to deal with the further complexity of timing. And, as young children are normally not able to hit such a teed ball very far, one or two fielders may be adequate to conduct an efficient practice session. But, once a child (or other beginning batter) of any strength learns to connect with a ball properly, the problem of having to recruit others to chase hit balls soon arises. And, in any case, it is at this point that the beginning batter is ready to graduate to learning the further fundamental art of hitting a ball while it is moving. It is in these respects that a tee quickly becomes an insufficient batting practice tool.

As a batter first progresses to swinging at pitched balls, it is best if the ball is tossed in a slow arc across the batter's torso region. However, as the batter's timing is perfected, the challenge becomes whether a ball pitched with some speed, or traveling in a particular nonlinear path, can be hit with consistency. But, again, throughout this long phase of training, recruiting fielders is problem. And, as a batter develops power, there is an increasing danger to the pitcher of being hit by batted balls.

Automatic pitching machines fulfill batters' needs for practice beyond the conventional, fully-manned playing field in the following respects. First, they are usually situated within a netted or fenced enclosure, thus obviating the need for fielders. And, second, a nearly unlimited number of balls may be pitched to the batter without tiring or endangering a pitcher. However, pitching machines are fairly expensive and therefore not suited to being purchased by the typical practicing batter. Most, instead, are used on a rental basis for short periods of time in arcades, and the like; the expense even in that environment being not insubstantial. And, finally, most beginning batters, such as children, need balls pitched much more slowly than is commonly available from pitching machines.

Over the years, in response to the above needs and drawbacks, a host of related "tethered ball"-type batting practice devices have been developed. All employ a tether of some sort, with a ball affixed to its end. The idea is that an operator grasps the tether's free end and swings the ball in a circular arc, thereby repeatedly presenting it to a practicing batter in a fashion akin to the ball's having been pitched. All manner of handles, tethers, swivels, springs and means for fastening a ball to a tether's end are represented in the art.

Tethered ball devices offer several advantages over other batting practice products and methods. They are inexpensive to manufacture; easy to learn to use; very versatile in the type of pitch which may be simulated; and, they require but a single operator and no fielders to carry out an effective batting practice session. However, all constructions are subject to several common flaws. First, when the batter misses the ball, the tether is likely to wrap around the bat, possibly pulling the tether from the operator's grasp as the batter's swing is completed. Although this problem does not frequently occur once a batter has developed a good eye and good timing, it constitutes a persistent inconvenience in training the type of batter to which such devices are best suited, i.e. children, and others of the most inexperienced sort.

A second common problem with tethered ball practice devices is that when the ball is properly hit, the load on the ball and closely adjacent portion of tether is so great that the ball has a tendency to be separated from the tether's end, whether by failure of that portion of the tether, or of the ball itself. Many proposals to cure this problem have been made, these including various methods of lashing the ball more securely to the tether, and providing strengthened leaders comprised of metal cable, and the like, adjacent the ball. But, these appear unduly expensive and impractical.

Twisting of the tether with repeated use is a third problem with prior constructions, and at least one such device incorporates a swivel into the tether to alleviate this. However, a swivel does not work as well as it might because as the ball is hit, which is the point at which it has its greatest spin, an unusually heavy load is put on the swivel. And, this load severely inhibits the swivel's free action.

Thus, it appears that a need has long existed for a tethered ball-type batting practice device constructed so as to reduce problems of its tether wrapping around the batter's bat. And, the device should also provide better means for keeping the ball and tether from being separated when hit. Finally, it is important that twisting in the tether is kept to a minimum.

SUMMARY OF THE INVENTION

The batting practice apparatus of the present invention is adapted to overcome the above-noted shortcomings and to fulfill the stated needs. A first claimed subcombination of elements thereof comprises a flexible tether having proximal and distal ends; a substantially spherical, mechanical energy-absorbing mass affixed to the tether's distal end; and, an elongate moderately flexible sleeve disposed in concentric relation with the tether, adjacent the tether's distal end.

A second claimed subcombination thereof comprises a flexible tether having proximal and distal ends, wherein the tether is comprised of a substantially nonresilient proximal portion and a linearly resilient distal portion. And, a substantially spherical, mechanical energy-absorbing mass is affixed to the resilient tether portion's distal end. A swivel may also be added between the resilient and nonresilient tether portions.

It is an object of the first claimed subcombination of the present invention to provide batting practice apparatus which eliminates the problem of its tether wrapping around the bat when the batter misses the ball.

It is an object of the second claimed subcombination of the present invention to provide batting practice apparatus which eliminates the problem of overloading and breaking the distal end of the tether, or ball connection, when the ball is hit.

A further object of this second subcombination, when a swivel is added, is to provide batting practice apparatus which more efficiently resists twisting in its tether portion.

And, in a combination which includes all of the above-claimed elements, all of the above are objects of the invention.

Still further objects of the inventive batting practice apparatus disclosed herein will be apparent from the drawings and following detailed description thereof.

DESCRIPTION OF THE PREFERRED EMBODIMENT

Figure 1:
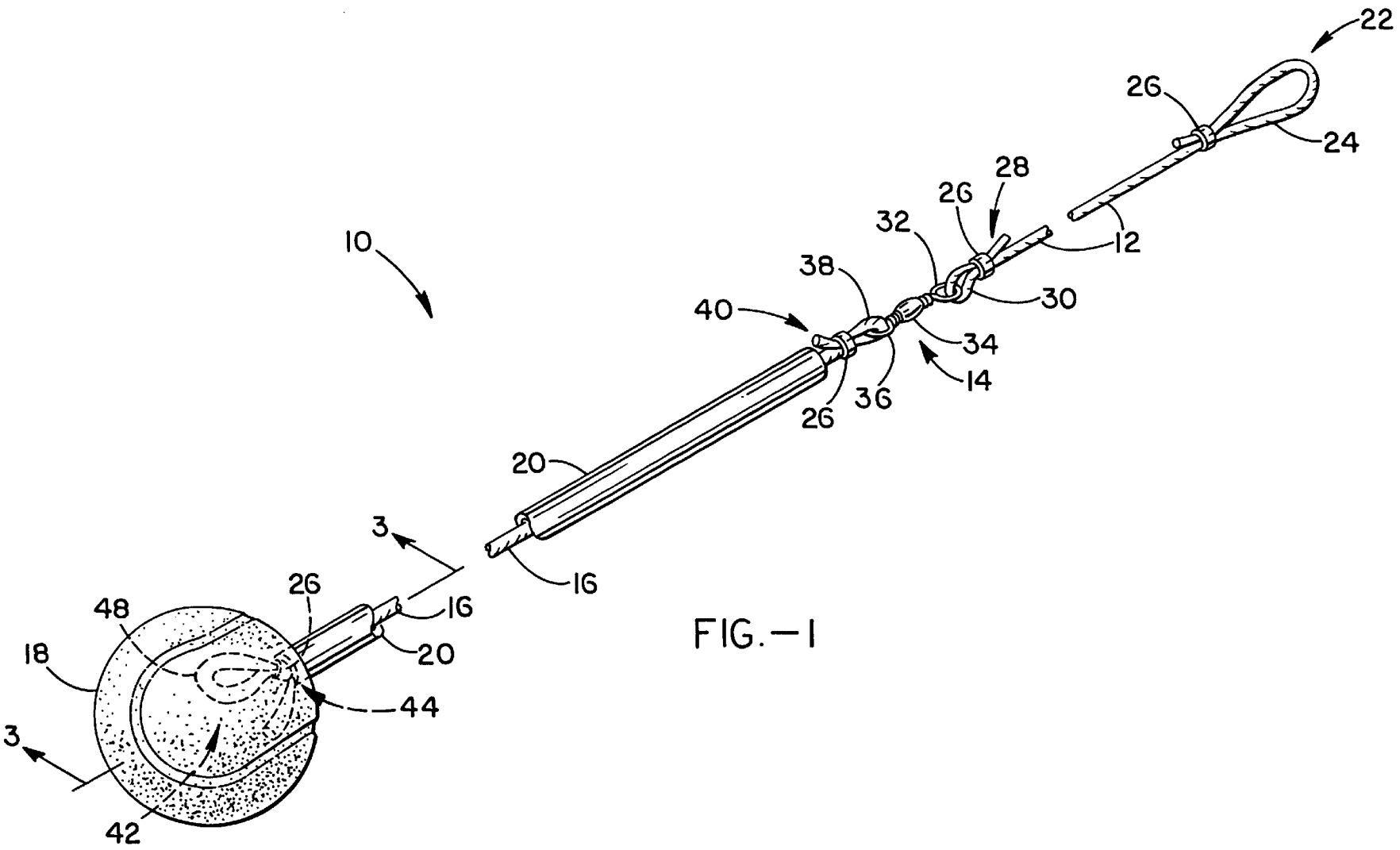
FIG. 1 shows a perspective view of the batting practice apparatus of the instant invention.
Figure 2:
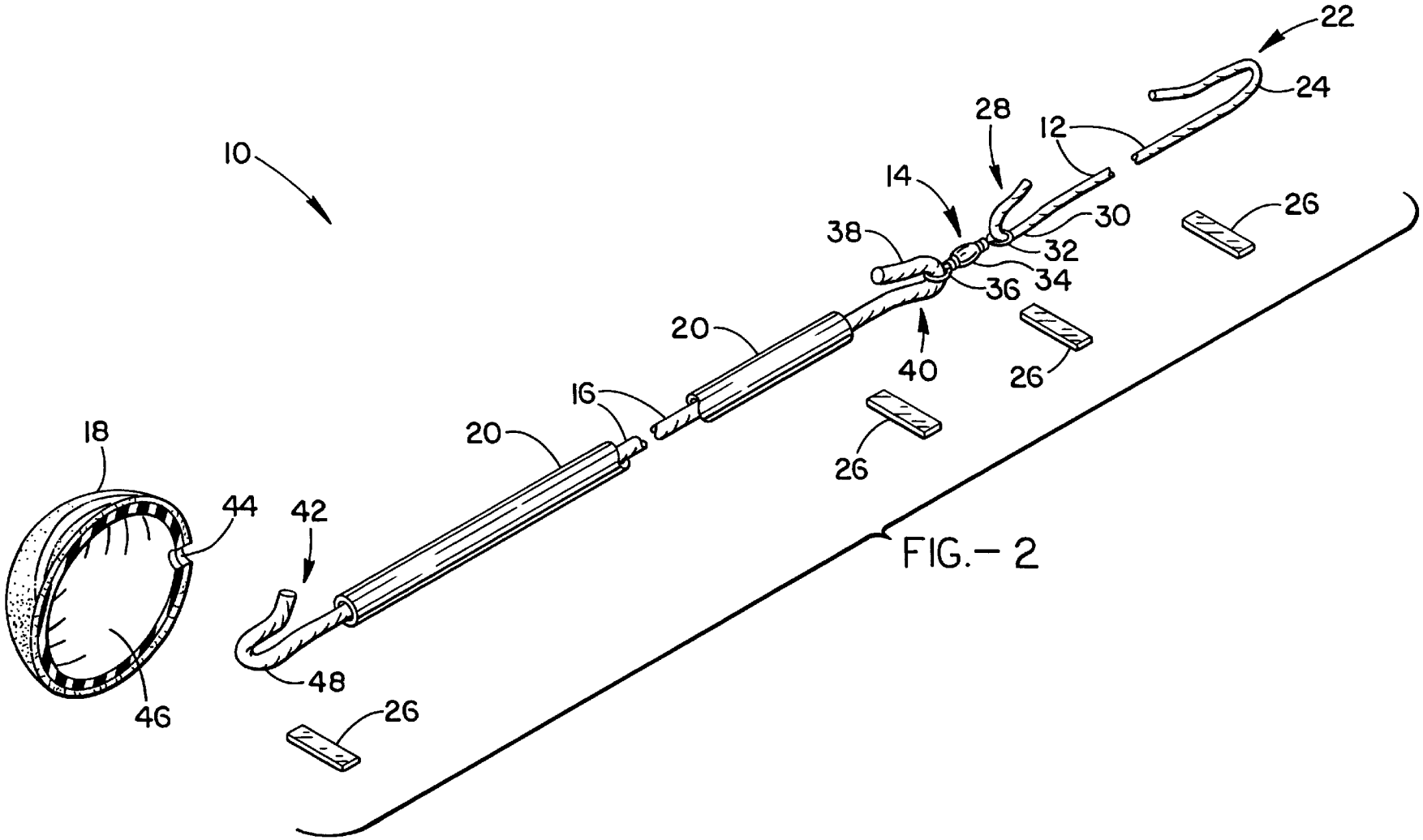
FIG. 2 shows an exploded perspective view of the apparatus of FIG. 1, the ball portion being shown in cross-section.

Referring now specifically to the drawings, FIGS. 1 and 2 show the batting practice apparatus of the present invention, which is generally identified therein with reference numeral 10. Apparatus 10's primary components include a nonresilient first tether portion 12, a swivel 14, a linearly resilient second tether portion 16, a ball 18 and a sleeve 20.

First tether portion 12 is preferably fashioned of a flexible, yet linearly nonresilient, cord. Such cord may be of natural or synthetic fiber, its most important requirements being that it be limp; substantially nonresilient in the direction of its length, i.e. linearly nonresilient; and, of sufficient tensile strength to resist being torn asunder when used for the purpose described herein. One type of cord used with success in practicing the invention is of nylon fiber, and has a diameter of ⅛ inch. And, the tensile strength of that cord is 68 lb. test. The optimum length of first tether portion 12 is considered to be 6 feet. However, it is contemplated that nonresilient tethers of other compositions, constructions and dimensions may work just as well in practicing the invention.

First tether portion 12's proximal end 22 is configured into a secure finger loop 24, held fast by a swaged collar 26. Collar 26 is preferably brass, or of some similarly easily formable metal.

First tether portion 12's distal end 28 is configured into a secure, somewhat smaller, first connecting loop 30, which is also held fast by a swaged collar 26. Loop 30 passes through, and is thereby securely connected to, first swivel eye 32 of swivel 14.

Swivel 14 is of the type commonly referred to as a "barrel swivel," as may used be for fishing or other purposes where it is important to prevent lengths of line from twisting. Swivel 14 is preferably constructed of brass, or the like, and its preferred size, using the common standard for such items, is a no. 0/1. Swivel 14's central portion, its "barrel" 34, is hollow and retains an enlarged distal portion of first swivel eye 32. Barrel 34 also retains an enlarged proximal portion of a second swivel eye, which is disposed distal to barrel 34 and is identified herein with reference numeral 36.

Second swivel eye 36 has second connecting loop 38 passing through it, second connecting loop 38 being disposed at linearly resilient second tether portion 16's proximal end 40. Second connecting loop 38 is held securely in place with a swaged collar 26.

Linearly resilient second tether portion 16 is preferably constructed of whet is commonly known as a "bungee cord" which is comprised of a plurality of individual rubber strands (not shown) bundled within a linearly extendable woven fabric sheath (unnumbered). The preferred bungee cord of second tether portion 16 is approximately 2 feet long, and approximately 3/16 inch in diameter. When second tether 16 is of the type described, this has been found to be optimum in constructing an apparatus 10 of sufficient durability for training children. But, a somewhat thicker bungee cord, say ¼ inch, or so, may be desired in constructing an apparatus 10 for use in training stronger batters. Although the forgoing described and preferred second tether portion 16 has been empirically found to work best, it is contemplated that linearly resilient tethers of alternative constructions, compositions and dimensions may work equally well in practicing the invention.

A short length of second tether portion 16's distal end 42 passes through an aperture 44 into the interior 46 of resilient ball 18. Ball 18 is preferably hollow, and of a durable rubber and fiber construction. It has been found that the type of ball commonly used for playing tennis is best suited to this purpose. A common tennis ball is roughly 2½ inches in diameter.

Distal end 42 is retained sufficiently firmly within ball 18 if aperture 44's diameter is just slightly less than tether portion 16's diameter. And, doubled portion 48 at distal end 42 of tether portion 16 is held securely in a doubled configuration with a swaged collar 26.

Linearly resilient tether portion 16 is disposed in concentric relation with, and slides freely within the bore of, elongate, moderately flexible, tubular sleeve 20. Sleeve 20's length approximates, but is preferably just a bit shorter than, tether portion 16 when the same is in an unextended posture. Such a sleeve of about 22 inches in length has been used with success.

The properties of sleeve 20 are important; it must be moderately flexible in all lateral directions. That is, sleeve 20 must be sufficiently durable so as not to be damaged by a bat's impact, and it must further be sufficiently flexible to yield when so hit. And, at the same time, sleeve 20 needs to be shape-retaining to resist wrapping around a bat, and to return immediately to a substantially linear configuration after a bat's impact.

Instrument grade, polyethylene, thermoplastic tubing extruded from high molecular weight resin has been found to be best suited for sleeve 20's purpose. When used with the 3/16 inch diameter bungee cord discussed above as being preferred for use in children's apparatus, a sleeve of such tubing having an outside diameter of 3/8 inch, and an inside diameter of 1/4 inch, has been found to work best. Further, the preferred tubing has a minimum bend radius of 1 1/4 inches.

In addition to the above, black polyethylene tubing is preferred over other colors because it least distracts the batter's eye from the ball. Further, as practice with apparatus 10 will commonly (but not necessarily) occur outdoors, the black tubing of the type chosen includes an ultraviolet light inhibitor to decrease degradation of the polyethylene, thereby to help increase the service life of the apparatus.

It is contemplated that tubings of other compositions, constructions and dimensions may also suffice in performing the function of sleeve 20, but the above-described tubing has, so far, been found to work best.

Figure 3:
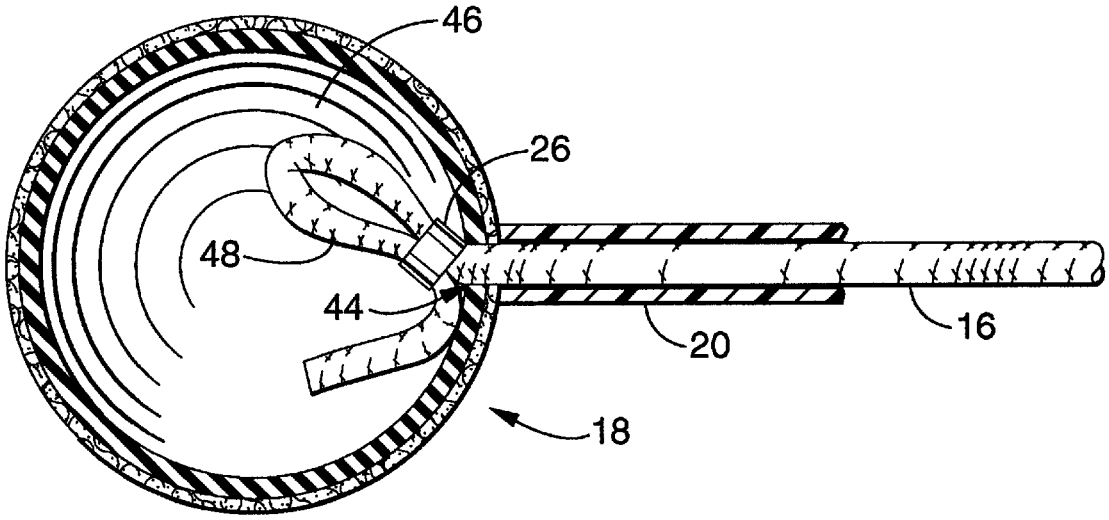
FIG. 3 shows an enlarged, fragmentary cross-sectional view of the ball portion and the means by which it is attached to the closely-adjacent, distal portion of the tether.
Figure 4:
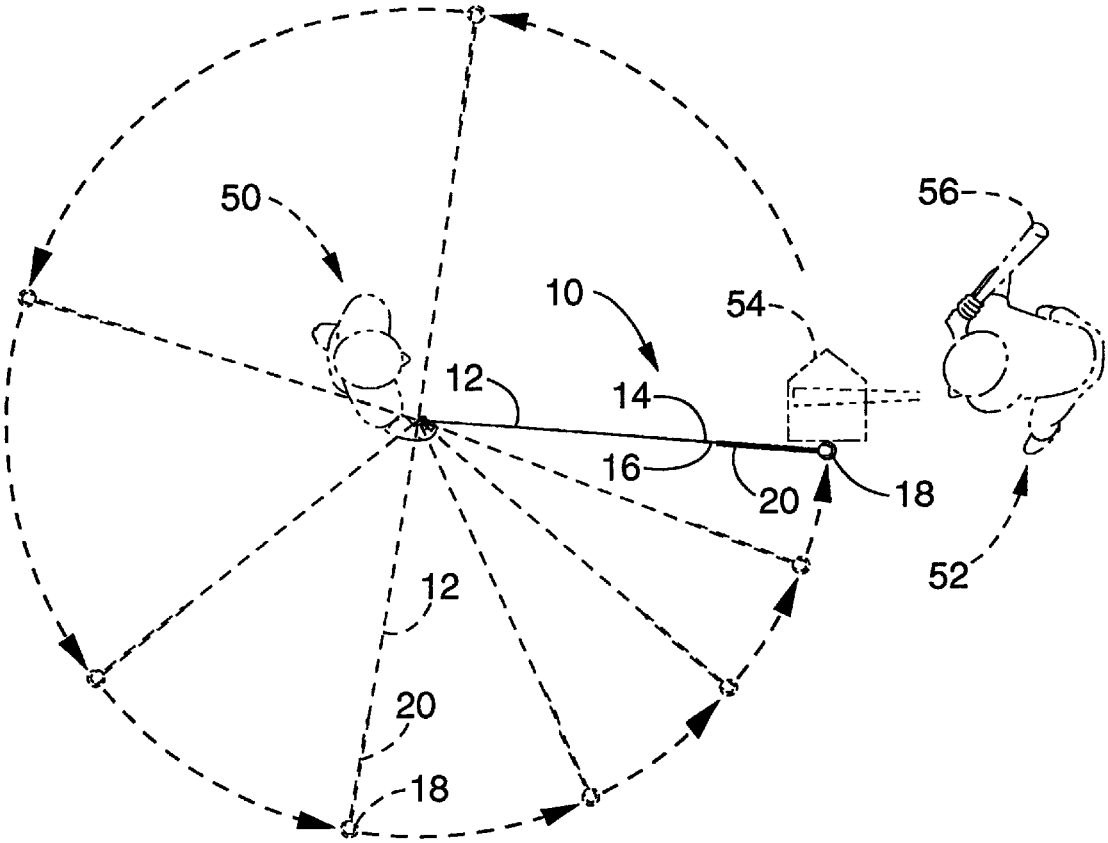
FIG. 4 is an overhead view showing the apparatus of FIG. 1 in use, wherein the proximal end of its tether is grasped in an operator's hand, and the ball at the distal end of the apparatus is swung in a circular arc, thereby presenting it to a practicing batter.

In use of apparatus 10, as illustrated in FIG. 3, an operator 50 simply grasps the proximal end 22 of first tether portion 12, preferably by securing finger loop 24 to a finger or the thumb. Alternatively, a secondary loop large enough to encircle the wrist may be pulled through loop 24. But, in any case, once apparatus 10 is so secured, operator 50 then grasps proximal end 22 of tether 12 firmly between the thumb and forefinger. Operator 50 then stands some 9 feet, or so, from the practicing batter 52 and swings ball 18 in a circular arc, thereby repeatedly presenting it to a practicing batter in a fashion akin to the ball's having been pitched.

When ball 18 is being presented to batter 52, it is preferred that it be caused to pass in front of the batter within the limits of a standard strike zone, the horizontal limits of which are represented by the position of the home plate 54 shown in the overhead view of FIG. 3. The strike zone's vertical limits are defined by the batter's knees, below, and by the upper extent of the batter's chest, above. Within these limits, operator 50 has great discretion in how to present ball 18 to practicing batter 52. For example, ball 18 may be caused to cross the strike zone in a generally horizontal path either high or low in the zone, or to the "inside" or "outside" with reference to the plate, and with respect to the batter. Further, combinations of these may be devised, such as "high-inside" or "low-outside." In addition, the experienced operator is able to adjust the plane of the ball's arc away from the horizontal, so that ball 18 may either drop or rise slightly when crossing the strike zone. And, finally, by the operator's making minute adjustments when the ball is approaching and crossing the strike zone, various specialty pitches such as the curve or slider may be simulated.

In executing the above simulated pitches, larger horizontal adjustments in the ball's placement are made by the operator standing or moving closer to, or farther away from, the batter. Adjustments in height are effected by the height of the operator's hand. And, the most subtle adjustments are controlled by changes in the position and movement of the operator's hand, wrist and forearm.

The practicing batter simply swings at ball 18 as if it were pitched. Once hit, the ball is usually driven out of its circular arc; thus, the operator must begin anew, and swing it into the proper motion again for presentation to the batter. However, occasionally, when the ball is not squarely hit, as would normally cause a "foul tip" in standard play, the ball continues on in the general direction of its original circular arc, in this case allowing it to be easily stabilized again by the operator.

This tennis ball, and the preferred bungee cord used in fashioning resilient second tether portion 16, cooperate to yield an apparatus which durably resists the ball being separated from the bungee, and which gives the practicing batter a very authentic feel when the ball is properly and squarely hit. It is hypothesized that, although the tennis ball used herein is quite a bit less massive than the ball used for the regular play of the games which this apparatus is primarily adapted to mimic, the bungee cord adds the necessary resistance to the system to compensate for the ball's missing mass, and gives the batter an authentic feel of having executed a successful hit. In addition, the bungee cord in combination with the relatively lightweight tennis ball makes it less necessary to waste the cost of a high-strength connection between the tether and the ball of such a device. Another reason for the tennis ball being preferred is that it has been found to be relatively harmless should the batter be struck, or should the operator or a bystander be struck with a direct hit, foul tip, or the like.

Further, the bungee cord seems to allow the swivel to work more efficiently than was possible in devices employing swivels with entirely nonresilient tethers. In this respect, it is hypothesized that the bungee works to reduce what might normally be an instantaneous and severe load within the swivel during the instant of the ball's greatest tendency to spin and, instead, causes this load to be more gradually increasing and decreasing. That is, the load is spread over some longer period of time, thereby permitting the swivel to work more efficiently. And, an additional benefit of this combination of a resilient distal tether portion with the swivel is that the likelihood of the swivel's failure is greatly reduced.

Sleeve 20's usefulness comes into play when the batter misses the ball. Instead of the bat 56 being wrapped in the bare tether as often happens with prior devices (for example, when the batter "chops" at the ball rather than swinging straight through in a horizontal direction), sleeve 20 of the instant invention flexes and absorbs the impact, but does not wrap around bat 56. Thus, practice is able to be resumed much more quickly than would normally be possible.

It should be noted that, if desired, the different combinations of the invention may be used separately to serve their individual purposes. For example, for training an experienced batter who is very unlikely to miss the ball, sleeve 20 may be unnecessary. But, the combination of a resilient and a nonresilient tether will nevertheless be beneficially employed. And, in contrast, although a beginning batter such as a child may have a swing too weak to threaten the integrity of the connection between the ball and tether, thereby making resilient tether portion essentially unnecessary, it will nevertheless be beneficial to employ sleeve 20 to avoid having the inexperienced batter's bat frequently tangled in the tether. Yet, despite these separable advantages, apparatus 10 as disclosed in its preferred embodiment constitutes a superior, all-purpose tethered ball-type batting practice apparatus.

The foregoing detailed disclosure of the inventive batting practice apparatus 10 is considered as only illustrative of the preferred embodiment of, and not a limitation upon the scope of, the invention. Those skilled in the art will envision many other possible variations of the structure disclosed herein that nevertheless fall within the scope of the following claims. For example, a handle may be added to tether portion 12's proximal end; or, tether portion 12 may be attached to, and operated by, a machine.

And, alternative uses for this inventive apparatus may later be realized. For example, it may be found beneficial in training players in the games of tennis, racquetball, squash, handball and other sports where the object is to strike a moving ball. Accordingly, the scope of the invention should be determined with reference to the appended claims, and not by the examples which have herein been given.

I claim:

1. Batting practice apparatus for repeated, rotationally-swinging presentation of a simulated ball to a practicing batter, said apparatus comprising:

a. a flexible tether having proximal and distal ends, said tether being comprised of a substantially nonresilient proximal portion and a linearly resilient distal portion;

b. a substantially spherical, mechanical energy-absorbing mass affixed to said tether's distal end; and, c. a moderately flexible sleeve disposed in concentric relation with said tether such that said linearly resilient portion of said tether slides freely therewithin.

2. The apparatus of claim 1, wherein said sleeve's length is approximately the same as the length of said tether's linearly resilient portion when said portion is in an unextended posture.

3. The apparatus of claim 1, further including means within the length of said tether for preventing twisting.

4. The apparatus of claim 1, wherein said sleeve is disposed between said twisting preventing means and said energy-absorbing mass.

5. Batting practice apparatus for repeated, rotationally-swinging presentation of a simulated ball to a practicing batter, said apparatus comprising:

a. a flexible tether having proximal and distal ends, said tether being comprised of a substantially nonresilient proximal portion and a linearly resilient distal portion, said linearly resilient distal portion comprising an inner core of a plurality of linearly resilient strands, and an outer linearly extendable, fabric sheath;

b. means for preventing twisting between said nonresilient tether portion's distal end and said linearly resilient tether portion's proximal end;

b. a substantially spherical, mechanical energy-absorbing mass affixed to said tether's distal end; and, c. a moderately flexible sleeve disposed in concentric relation with said tether such that said linearly resilient portion of said tether slides freely therewithin, said sleeve being sufficiently durable not to be damaged by a bat's impact and sufficiently flexible to yield when so hit and, at once, shape-retaining, to resist wrapping around a bat and to return immediately to a substantially linear configuration after said bat's impact.

6. Batting practice apparatus for repeated, rotationally-swinging presentation of a simulated ball to a practicing batter, said apparatus comprising:

a. a flexible tether having proximal and distal ends, said tether being comprised of a substantially nonresilient proximal portion and a linearly resilient distal portion;

b. means for preventing twisting between said nonresilient tether portion's distal end and said linearly resilient tether portion's proximal end;

b. a substantially spherical, mechanical energy-absorbing mass affixed to said tether's distal end; and, c. a moderately flexible sleeve disposed in concentric relation with said tether such that said linearly resilient portion of said tether slides freely therewithin, wherein said sleeve's length is approximately the same as the length of said tether's linearly resilient portion when said portion is in an unextended posture, and wherein said sleeve is disposed between said twisting preventing means and said energy-absorbing mass.

* * * * *